United States Patent [19]

Flüeli et al.

[11] Patent Number: 4,762,284

[45] Date of Patent: Aug. 9, 1988

[54] ENCLOSURES FOR HIGH-SPEED WINDERS

[75] Inventors: Adolf Flüeli; Kurt Schefer; Heinz Oswald, all of Winterthur, Switzerland

[73] Assignee: Maschinenfabrik Rieter AG, Winterthur, Switzerland

[21] Appl. No.: 879,292

[22] Filed: Jun. 27, 1986

[30] Foreign Application Priority Data

Jul. 5, 1985 [GB] United Kingdom ..... 8517173

[51] Int. Cl.[4] ..... B65H 67/044

[52] U.S. Cl. ..... 242/18 A; 242/18 DD; 242/35.5 R

[58] Field of Search ..... 242/18 A, 18 R, 35.5 R, 242/25 A, 25 R, 56 R, 56 A, 67.1 R, 47, 1, 18 DD; 57/1 R, 356

[56] References Cited

U.S. PATENT DOCUMENTS

| | | | |
|---|---|---|---|
| 2,971,710 | 2/1961 | Bunch | 242/25 A |
| 3,146,572 | 9/1964 | Keyser | 57/1 R |
| 3,274,803 | 9/1966 | Schmidt | 66/168 |
| 3,782,087 | 1/1974 | Franzen et al. | 57/1 R |
| 3,877,653 | 4/1975 | Foltyn et al. | 242/25 A |
| 3,918,650 | 11/1975 | Kemel | 242/25 R |
| 3,955,347 | 5/1976 | Schippers | 57/1 R |
| 4,347,989 | 9/1982 | Pieper et al. | 242/35.5 R |
| 4,377,264 | 3/1983 | Kovaleski | 242/25 R |
| 4,524,918 | 6/1985 | Feusi | 242/18 DD X |
| 4,570,743 | 2/1986 | Wetter | 242/35.5 R |

FOREIGN PATENT DOCUMENTS

| | | |
|---|---|---|
| 55-123848 | 12/1980 | Japan . |
| 2070084 | 9/1981 | United Kingdom . |
| 2100765 | 1/1983 | United Kingdom . |

*Primary Examiner*—Stanley N. Gilreath
*Attorney, Agent, or Firm*—Werner W. Kleeman

[57] ABSTRACT

A machine for winding thread comprising an operating region in which thread packages are formed and retained, if necessary, to await doffing thereof. At least one chuck is provided in the operating region, which is rotatable about a longitudinal chuck axis for winding of thread into a package thereon and has a predetermined doffing position in the operating region. An enclosure having at least one access door is provided for the operating region, the door being movable relative to the enclosure for exposing an access opening to said doffing position while the enclosure hinders access to other portions of the operating region.

28 Claims, 9 Drawing Sheets

PRIOR ART 80
42
96 A
90A
70
86A
116
200
198
38
114
106
105
100A
24
110
112
102 A
PC
102
108
26
104
100
200
98
86
92
82
94
68
88
90
84
96
72
40

ENCLOSURES FOR HIGH-SPEED WINDERS

CROSS REFERENCE TO RELATED APPLICATION

This application is related to the commonly assigned, U.S. Pat. No. 4,598,876, granted July 8, 1986, and entitled "WINDING MACHINE FOR FILAMENT PACKAGES EQUIPPED WITH PACKAGE SCREENING MEANS".

BACKGROUND OF THE INVENTION

The present invention relates to improvements in enclosures for the operating regions of high-speed winding machines, for example take-up winders for threads formed of synthetic filament. In this context, the term "high-speed" refers generally to speeds in excess of 2000 m/min., and especially to speeds in excess of 4000 m/min.

Generally speaking, the machine of the present invention is for winding thread and has an operating region in which thread packages are formed and retained, if necessary, to await doffing thereof and has a predetermined doffing position in the operating region. The machine comprises at least one chuck, but preferably at least two chucks, arranged in the operating region and defining a longitudinal chuck axis.

In a further embodiment, the machine of the present invention is for winding thread and has an operating region in which thread packages are formed and retained, if necessary, to await doffing thereof. The machine comprises at least two chucks arranged in the operating region and defining respective longitudinal axes.

Enclosure of the main drives and ancillary operating parts of textile machines has of course been common practice since the inception of such machines. Enclosure of the "operating regions" of those machines, for example the regions in which thread is spun and/or wound, is much less common, but has been proposed for a number of different purposes. For example, in U.S. Pat. No. 3,146,572, granted Sept. 1, 1964, it is proposed that raisable and lowerable shutters should be used to define an enclosed space containing the machine, which space can be controllably climatized in use. The shutters can be raised and/or lowered in order to provide access to the relevant operating regions when required. The arrangement has not found wide acceptance in the industry.

U.S. Pat. No. 3,782,087, granted Jan. 1, 1974, describes a twisting machine in which selected regions of the machine, especially the spindle assemblies, are selectively shielded to control noise emission. Raisable and lowerable shutters are again shown in FIGS. 10 to 16 of this patent.

U.S. Pat. No. 3,274,803, granted Sept. 27, 1966, describes a knitting machine in which the actual knitting region is enclosed to protect it from dust penetration, the enclosure including horizontally slidable transparent doors enabling selective access to the knitting region.

Surprisingly, the idea of enclosing the operating region of the machine has been extended only comparatively recently to the enclosure of the operating region of take-up winders, for example, for threads of synthetic filament. A recent proposal for such enclosure is, however, shown in the European Published Patent Application, published under the No. 0 141,936, on May 26, 1985, corresponding with U.S. Pat. No. 4,570,743, granted Feb. 18, 1986, filed in the name of Kurt Wetter and entitled "NOISE PROTECTION DEVICE FOR A WINDING UNIT". In that proposal, an access door extends over the whole of the front face of the winder, and is movable to the side thereof when access is required to the operating region, for example, for threading up or doffing of packages. The proposal is intended especially to limit noise emission from the winder.

SUMMARY OF THE INVENTION

Therefore, with the foregoing in mind, it is a primary object of the present invention to provide a new and improved construction of a machine for winding thread which does not exhibit the aforementioned drawbacks and shortcomings of the prior art constructions.

Another and more specific object of the present invention aims at providing a new and improved construction of a machine of the previously mentioned type for winding thread and containing a multi-functional enclosure for high-speed thread winding machines which limits or controls noise emission from the operating region of the winder.

Another important object of the present invention is to improve safety in operation of a thread winding machine by enabling only predetermined access to the operating region in contradistinction to many of the arrangements of the prior art, in which unhindered access to the operating region for the performance of service operations is enabled as far as possible.

Yet a further significant object of the present invention aims at providing a new and improved construction of a machine of the character described for winding thread and provided with a safety enclosure which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the winding machine of the present invention for winding thread is manifested by the features that the at least one chuck and preferably the at least two chucks are each rotatable about their associated longitudinal chuck axis for winding thread into a package thereon. The winding machine comprises an enclosure for the operating region and an access opening to a predetermined doffing position which is spaced from a winding position in the operating region. At least one access door is arranged in the enclosure and is movable relative to the enclosure for exposing the access opening to the predetermined doffing position while the enclosure hinders access to other portions of the operating region.

A further embodiment of the machine for winding thread of the present invention is manifested by the features that the at least one chuck is rotatable about the longitudinal chuck axis for winding thread into a package thereon. The machine comprises an enclosure for the operating region. At least one access door is arranged in the enclosure. The machine further comprises controllably releasable retaining means operable for retaining the at least one access door in a state closing the enclosure and releasable for permitting opening of the at least one access door for providing access to the at least one chuck for removing a completed package therefrom. The machine also comprises a sensing means responsive to the state of the at least one chuck as well as control means responsive to the sensing means and operable for controlling the retaining means such that the at least one access door cannot be released unless the at least one chuck is in a predetermined state.

A still further embodiment of the machine for winding thread of the present invention is manifested by the features that the at least one chuck has a predetermined doffing position in the operating region. The machine comprises an enclosure for the operating region. The machine also comprises a doffing access door movable relative to the enclosure for providing access to the at least one chuck in the predetermined doffing position for removing packages therefrom. The machine also comprises a further access door movable relative to the enclosure for providing access to the operating region for performing, as desired, occasional operations.

Another embodiment of the machine for winding thread of the present invention is manifested by the features that each chuck of the at least two chucks is rotatable about a respective longitudinal axis of the respective longitudinal axes for winding thread into a package thereon. Each chuck has a respective doffing position in which the chuck is located for removal of a completed package therefrom. The machine comprises an enclosure for the operating region. The enclosure comprises two access openings respectively associated with the respective doffing positions of each chuck as well as two doors each associated with a respective access opening of the two access openings. Each door is movable relative to the enclosure between an operative position closing its respective opening and an inoperative position in which it leaves a therewith-associated opening of the two access openings free for removing a thread package but overlies at least partly the other opening of the two access openings.

The abovementioned functions are realized in a layout which is economical in space, a feature frequently very significant, for example, when space is at a premium in layout of a complete installation comprising a large number of take-up winders located in a "battery".

The following features are common to all embodiments of the invention:

The invention provides a machine for winding thread comprising an operating region in which thread packages are formed and retained, if necessary, to await doffing thereof. In the operating region, there is at least one chuck rotatable about a longitudinal chuck axis for winding of thread into a package thereon. The chuck has a predetermined doffing position in the operating region; the chuck is located in this position during removal of completed thread packages therefrom. The invention is intended particularly, but not exclusively, for application to a winder in which at least two chucks are provided in the operating region, each chuck being rotatable about its respective longitudinal chuck axis and being operable to wind packages sequentially to enable virtually continuous winding of thread. The operating region may contain other operating elements for cooperation with the chuck or with a thread during package winding, for example, a friction drive roller for contacting the circumference of a package during winding thereof or a traverse mechanism for traversing a thread longitudinally of the chuck axis during package winding or both.

In all embodiments of the invention, an enclosure is provided for the operating region.

According to one aspect of the invention, in which at least one chuck is provided in the operating region, the enclosure comprises at least one access door openable to enable access to the doffing position of the at least one chuck and a controllably releasable retaining means is provided for the door. The retaining means is operable for retaining the door in a state closing the enclosure and for releasing the door to permit opening thereof to provide access to the doffing position. There is also a sensing means responsive to the state of the chuck, and control means responsive to the sensing means and operable for controlling the retaining means. The arrangement is such that the door cannot be released unless the chuck is in a predetermined state, for example, located in its doffing position and at a standstill.

According to further features of the same aspect, the control means is also operable for controlling a drive means for driving the chuck. A sensor means is provided responsive to the state of the door, and the control means is responsive to the sensor means so that the chuck drive means cannot be operated unless the door is in a predetermined state, for example, closed.

In a second aspect of the invention, also in which at least one chuck is present in the operating region, an access door is provided in the enclosure and is movable relative to the enclosure for exposing an opening providing access to the doffing position of the chuck. However, when the door is fully open for enabling access to the doffing position, the enclosure still hinders access to other portions of the operating region, for example, those containing other operating elements. This aspect can be applied especially to a machine comprising at least two chucks in the operating region, and the enclosure then hinders access to an ongoing winding operation on one chuck while enabling access to the doffing position for removal of packages from the other chuck. There may be two such doffing positions, one for each chuck, or a single doffing position for both chucks. Each doffing position is spaced from a winding position in the operating region.

In a third aspect of the invention, also in which at least one chuck is present in the operating region, a doffing access door is provided and is movable relative to the enclosure for providing access to the doffing position of the chuck. A further access door is also provided and is movable relative to the enclosure for providing additional access to the operating region for occasional operations such as, for example, threading-up of the machine or service of selected operating elements, or both. In this embodiment the doffing access door is preferably mounted on and movable relative to the further access door. Alternatively, however, the doffing access door and the further access door can be separate from each other.

In a fourth aspect of the invention, in which at least two chucks are provided in the operating region, the enclosure comprises at least two access openings respectively associated with the doffing positions of the at least two chucks. At least two doors are associated with each of the respective access openings, each door being movable relative to the enclosure between an operative position closing its respective opening and an inoperative position. In the latter position, each door leaves its respective associated opening free for removal of a thread package, while overlying at least partly another opening. This enables efficient utilization of space, bearing in mind the fact that the at least two openings are not intended to be free simultaneously.

In the preferred embodiments of all of these aspects of the invention, the enclosure comprises a "front wall" through which selective access to the operating region is to be enabled. The enclosure preferably comprises continuous side walls which do not permit access to the operating region when they are in place. A top wall of the enclosure may be either continuous, preventing access to the operating region, or may have a very limited access opening for certain specific functions, for example, in threading up. The rear of the operating region preferably adjoins a headstock and the operating region enclosure then preferably merges into a headstock enclosure. The enclosure may comprise a bottom plate, but this may be omitted where the machine is designed to stand upon an adequate base or support, for example, a floor. The remaining walls of the enclosure can then form a hood closely approaching this base at its lowermost edges.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Before commencing the detailed description of the drawings, a general discussion of machines for winding thread, often called filament winding machines, will be presented in order to permit a more facile understanding of the present invention.

Filament Winding Machines—General

Take-up winders for synthetic plastics or synthetic plastic filaments or threads are currently available in two basic types, namely:

(a) a multi-chuck winder with means for transferring a continuously delivered thread from one chuck to another so as to enable substantially continuous or "wasteless" package winding, and (b) single chuck or multi-chuck winders without such transfer arrangements, so that package winding must be terminated during removal of completed packages.

The present invention is intended particularly, but not exclusively, for application to the former type of winder where safety aspects or measures are especially important during doffing (i.e. removal) of completed filament packages or wound thread packages from one chuck during an ongoing winding operation on the other chuck. One design of continuous winder is shown in the aformentioned commonly assigned European Published Patent Application No. 73,930, the disclosure of which is incorporated herein by reference, and which is hereinafter referred to as "the prior application". The invention can be applied to alternative designs of continuous winder, for example, the so-called "revolver" type, an example of which is illustrated in U.S. Pat. No. 4,298,171, granted Nov. 9, 1981. Still further possibilities will be referred to towards the end of the description, including the application of the principles of the invention to single-chuck type winders, for example, as illustrated in U.S. Pat. No. 4,347,989, granted Sept. 7, 1982.

Describing now the drawings, it is to be understood that to simplify the showing thereof only enough of the structure of the machine for winding thread has been illustrated therein as is needed to enable one skilled in that art to readily understand the underlying principles and concepts of this invention.

Prior Art Filament Take-up Winder

Figure 1:
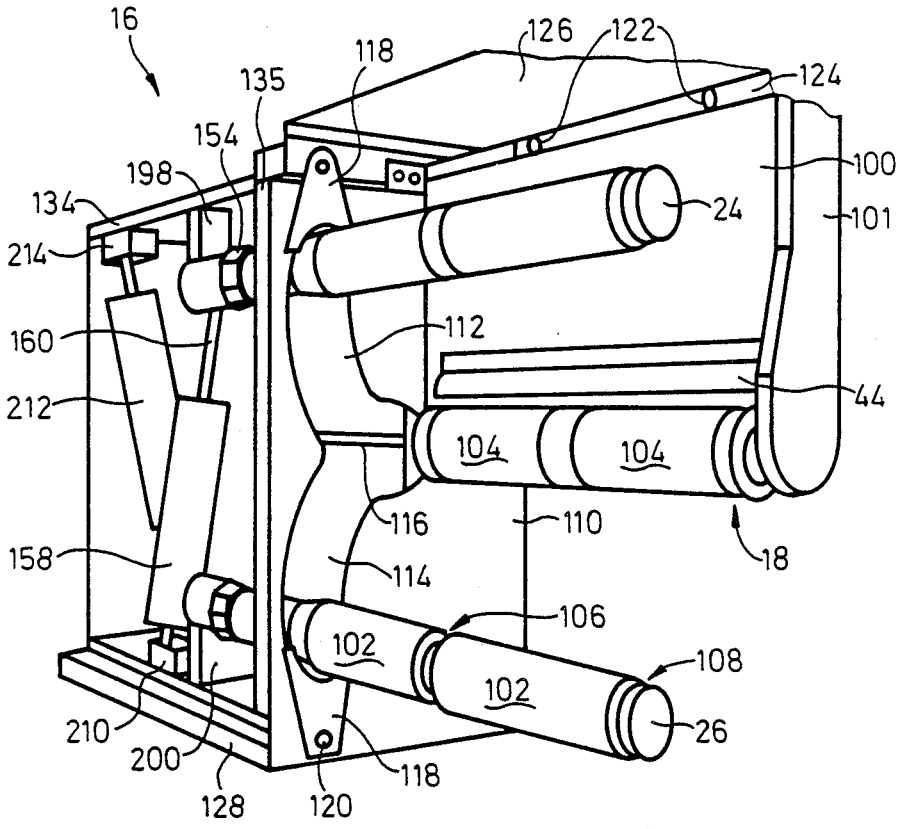
FIG. 1 is a perspective view of a prior art winding machine already commercially available from Rieter Machine Works Ltd., the assignee of this application, and constructed in accordance with the published European Patent Application published under the No. 73,930.
Figure 8:
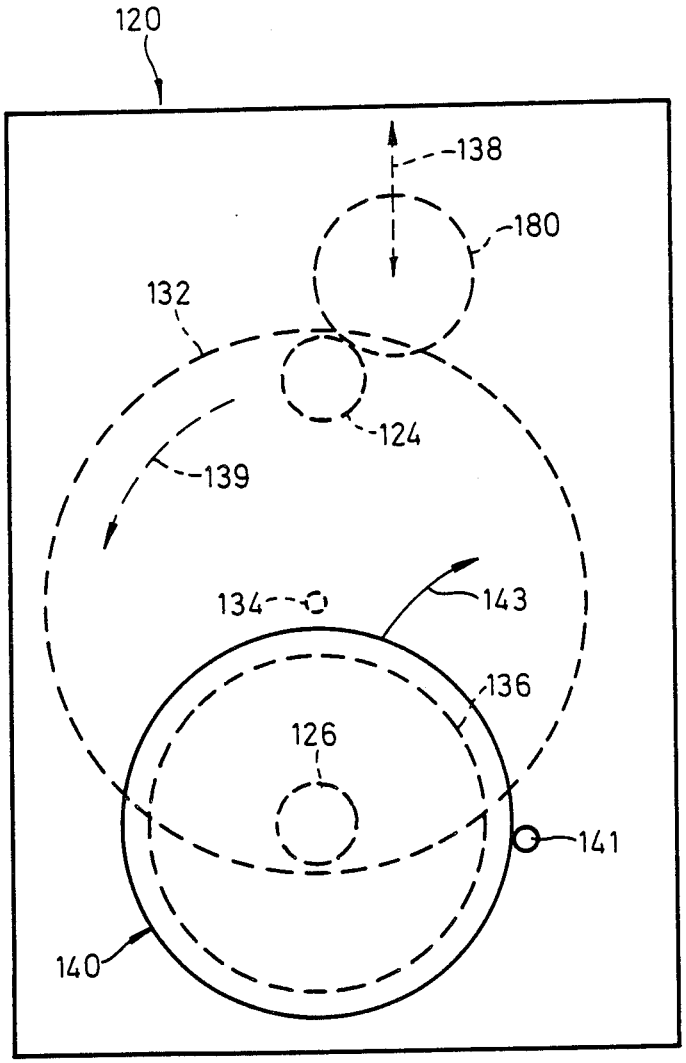
FIG. 8 is a front elevation of a type of winding machine different from that shown in FIG. 1 but also including an enclosure in accordance with the principles of the present invention.

Turning now specifically to FIG. 1 of the drawings, the apparatus illustrated therein by way of example and not limitation is substantially a copy of FIG. 8 of the aformentioned prior application, namely European Published Patent Application No. 73,930. In order to enable ready comparison, the original reference numerals have been retained for the present description. Since full details of the machine are available from the aforesaid published European Published Patent Application No. 73,930, only a very brief outline will be repeated in this specification.

The reference numeral 16 designates a headstock housing containing drive systems, control systems and supports for the major operating elements which project forwardly from the front face of the headstock housing 16. Only some of those systems and supports have been shown in FIG. 1. Other, not particularly illustrated systems are shown in the aforesaid European Published Patent Application No. 73,930, and still further, conventional, systems may be included as is well-known in the art.

Turning now to those Figures of the drawings depicting more specifically the measures of the present invention, FIG. 1 will be seen to illustrate a front face of the headstock housing 16 represented by a plate 110 having slots 112 and 114 for a purpose yet to be described. Slots 112 and 114 converge towards and intersect one another adjacent a friction drive roll 18 extending forwardly from the plate 110. The friction drive roll 18 is supported by not particularly shown conventional support means at one end in the headstock housing 16, and at the other end in a support structure 100, 101 which projects cantilever-fashion from the front face of the headstock housing 16. The friction drive roll 18 can be driven in rotation about its longitudinal axis by means of a drive shaft 116 extending into the headstock housing 16 to a not particularly shown conventional drive means situated therein.

Two further major operating elements illustrated in FIG. 1 are respective upper and lower chucks 24 and 26. As will be further described, these respective upper and lower chucks 24 and 26 are supported within the headstock housing 16 so as to project cantilever-fashion through respective ones of the slots 112 and 114. In operation, each respective chuck 24 and 26 carries conventional bobbin tubes (two of which are shown at 102 at the lower chuck 26) upon which respective thread packages are wound. To enable this, each respective upper and lower chuck 24 and 26 is movable along its respective slot 112 and 114 between a predetermined doffing position (in which the respective chuck 24 or 26 is at the end of its respective slot 112 or 114 remote from the friction drive roll 18, as illustrated in FIG. 1) and a position in which the bobbin tubes 102 are brought into contact with respective drive regions 104 formed on the friction drive roll 18. In other words, each respective doffing position of the upper and lower chucks 29 and 26 is spaced from a substantially common winding position associated with the friction drive roll 18.

In use, the respective upper and lower chucks 24 and 26 are alternatingly brought into the winding state or position, that is into winding contact with the friction drive roll 18. While one chuck 24 or 26 is in the winding state or position, the other is maintained in its doffing position. When formation of thread packages on the one chuck 24 or 26 is completed, a changeover operation is effected so that the threads are transferred from the one chuck to the other as the latter is moved into its winding state. Details of the changeover operation are provided in the aforementioned European Published Patent Application No. 73,930. The respective upper or lower chuck 24 or 26 bearing the respective completed packages (the "outgoing" chuck) is returned to its doffing position while winding of thread continues on the other chuck. When rotation of the respective upper or lower chuck 24 or 26 in the doffing position has ceased, not particularly shown conventional release mechanisms within the chuck structure release the packages formed thereon, and these can be pushed off the respective upper or lower chuck 24 or 26, as the case may be, on command by the appropriate one of a pair of upper and lower push-out or expulsion shoes 118 associated with the respective doffing positions. A lower operating shaft for reciprocating a lower push-out or expulsion shoe of the pair of push-out shoes 118 longitudinally of its respective lower chuck 26 is designated by the reference numeral 120, and a similar not particularly referenced upper operating shaft is provided for an upper push-out or expulsion shoe of the pair of push-out shoes 118.

For completion of description of the major operating elements forward of the plate 110, it will be noted that a conventional traverse mechanism also projects forwardly from the plate 110, but in FIG. 1 this conventional traverse mechanism is concealed by the support structure 100, 101. The threads delivered to the respective upper and lower chucks 24 and 26 pass downwardly behind the support structure 100, between the traverse mechanism and the support structure 100, around the friction drive roll 18 and their respective packages. Two bobbin tubes 102 have been illustrated in FIG. 1 merely by way of example. In practice, it is possible to form only one package per chuck, or there may be more than two packages (commonly up to 8) per chuck. For ease of description, in the remainder of this specification only a single thread will be referred to. It will be understood, however, that all operations described for this thread apply equally to any other threads wound simultaneously.

As more fully described in the aforesaid European Published Patent Application No. 73,930, each respective upper and lower chuck 24 and 26 is supported on a respective not particularly shown conventional swing-arm within the headstock housing 16. The upper chuck 24 is secured to its respective swing-arm by a set of clamping jaws 154, and a similar not particularly referenced set of jaws is illustrated for the lower chuck 26. The respective swing-arm bearing the upper chuck 24 can be moved through a defined swing-angle sufficient to move the chuck from its doffing position into the therefrom spaced winding state or position by a piston and cylinder assembly, the cylinder of which is seen at 158 and the not particularly shown conventional piston of which is connected to the respective swing-arm by a connecting rod 160. The respective swing-arm bearing the lower chuck 26 is operated by a similar piston and cylinder assembly, only the cylinder of which is visible at 212.

The main structural elements of the headstock housing 16 include a base plate 128 and an upper plate 134 parallel to the base plate 128. The cylinder 158 is pivotally secured to a boss 210 on the base plate 128, and the cylinder 212 is pivotally secured to a boss 214 mounted on the underside of the upper plate 134. The reference numeral 198 designates a support element secured to the upper plate 134 and carrying a not particularly shown conventional brake-shoe for braking rotation of the upper chuck 24 after this upper chuck 24 returns to its doffing position upon completion of a winding operation. A similar support element 200 is mounted on the base plate 128 for association with the lower chuck 26.

The reference numeral 135 designates a bracing strut in the headstock housing 16, and other vertical structural elements are provided in such housing 16 as already described in the prior application. The reference numerals 106 and 108 respectively designate locations at which conventional thread catching and severing devices are provided on the lower chuck 26. Since these devices are of a known type, and form no part of the present invention, they will not be referred to again in this specification. The arm 124, with its rollers 122, indicated at the upper right in FIG. 1 was used for threading of the machine as described in the prior application; the embodiment to be described with reference to FIGS. 2 to 7 includes an alternative threading system, so that the arm 124 will not be referred to again in this specification.

The aforementioned European Published Patent Application No. 73,930 refers to an "operating region" in front of the plate 110. Although the operating region was not precisely defined in such prior application, it can be considered to comprise the space forward of the plate 110 at least as far as the end of the support structure 100, 101, that is the region containing the major movable parts operating on the thread in each winding operation. In the machine shown in FIG. 1, a hood 126 was provided over the operating region. As will now be described, the present invention provides an enclosure for this region, with a corresponding substantial improvement in safety and in environmental conditions in the neighborhood of the winder or winding machine. The modifications to be described refer only to the enclosure of the operating region of the winder. The major operating elements remain substantially unchanged except for the mounting of the friction drive roll 18. In the embodiment to be described, the support structure 100, 101 is eliminated, and the friction drive roll 18 is supported cantilever-fashion within the headstock housing 16. Since this arrangement is in any event conventional, it will not be described in detail.

Developments Provided By Invention

Figure 2:
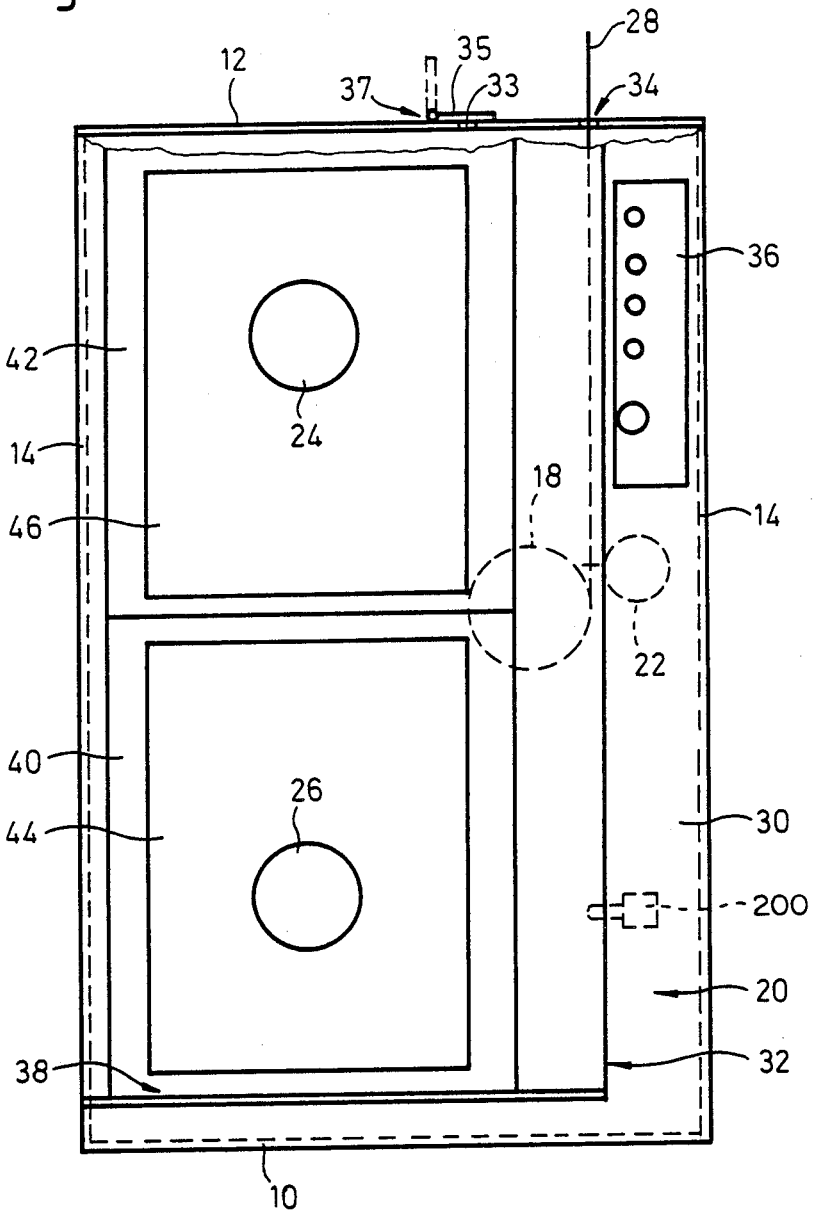
FIG. 2 is the front elevation of a machine basically similar to that shown in FIG. 1 but modified to include an enclosure according to the present invention.

The inventive measures or aspects to be described permit total enclosure of the operating region. Basically, this requires the design of a casing around that region. Only the front wall of this casing is of special significance in relation to the present invention. The remainder of the casing is provided simply by extending the base plate 128, the top plate 134 and not particularly shown conventional side plates of the headstock housing 16 forwardly of the plate 110. In FIG. 2, the forward extension of the base plate 128 is indicated at 10, that of the top plate 134 at 12, and the forward extension of the side plates are indicated at 14.

The front wall shown in FIG. 2 comprises a fixed wall portion 30 and a door assembly 32. The door assembly 32 is hinged by conventional means not particularly shown in FIG. 2 to the fixed wall portion 30 for swinging about a vertical axis adjacent the left-hand side of the door assembly 32 as viewed in FIG. 2.

The general layout of the major operating elements in the operating region has also been indicated diagrammatically in FIG. 2. Thus, the outline of the friction drive roll is indicated at 18, the outlines of the respective upper and lower chucks 24 and 26 in their respective doffing positions are indicated by these appropriate reference numerals and the outline of the conventional traverse mechanism is indicated at 22. The path of a thread entering the winding machine or winder from above and extending as far as its first contact with the friction drive roll 18 is indicated at 28.

A slot 34 is provided in the top wall or top plate extension 12 in order to permit the thread to enter the winding machine. The slot 34 is elongated and extends parallel to the longitudinal axis of the friction drive roll 18. The slot 34 extends forwardly to the front edge of the plate or top plate extension 12, for a purpose which will be described immediately below. The slot 34 extends rearwardly from the front edge over a distance sufficient to permit the normal traversing movement of the or each thread delivered to the winding machine. The plate or top plate extension 12 has a second slot 33 extending from the front edge of the plate or top plate extension 12 rearwardly parallel to the slot 34. The second slot 33 is normally covered by a cover plate 35 which is pivotable about a not particularly shown conventional hinge at its left-hand edge. The cover plate 35 is pivoted away from the plate or top plate extension 12, to expose the second slot 35 from above, only during a threading and start-up operation as referred to briefly below.

The door assembly 32 extends from its hinged left-hand side across a front wall 20 to a right-hand edge located to the right of the slot 34. The door assembly 32 extends upwardly to the top edge of the plate or top plate extension 12. Accordingly, when the door assembly 32 is swung open about its hinge, access is provided to almost the whole of the operating region including in particular the front, open edge of the slot 34 and a thread path 28 to the friction drive roll 18, and beyond that friction drive roll 18 upwards to the slot 33, which has been opened by pivoting the cover plate 35 away from the plate or top plate extension 12. The length of thread between the friction drive roll 18 and the slot 33 is available for a start-up operation for winding thread initially on the lower chuck 26 as in the aforementioned European Published Patent application No. 73,930. This operation is not relevant to the present invention and will not be described in detail. The start-up operation can be effected automatically once the thread has been suitably located in the start-up position. Initiation of the start-up operation can be triggered by pressing a button on a control panel 36 built into the fixed wall portion 30.

Figure 5:
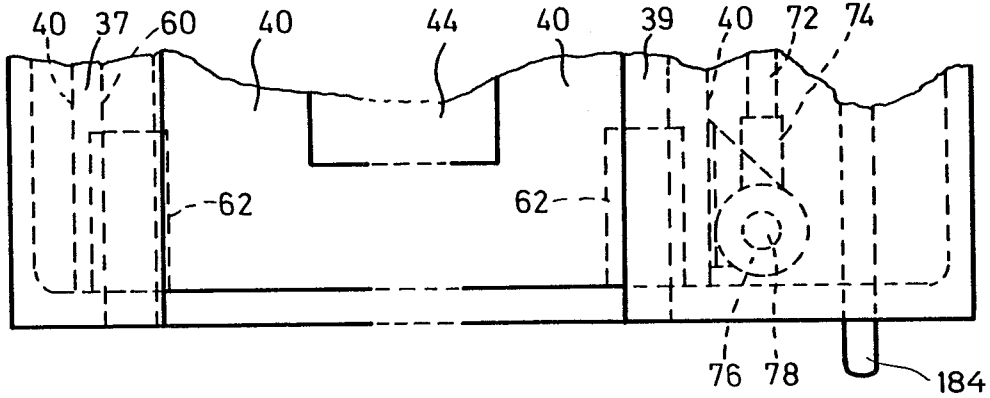
FIG. 5 is a front elevation of the lowermost corners of the door assembly, drawn on a scale corresponding to that of FIG. 4.

The door assembly 32 includes a frame 38 which holds two movable doors 40 and 42, respectively, as will be described below with reference to FIGS. 3 to 5 inclusive. Each movable door of the two movable doors 40 and 42 comprises a respective transparent sheet or panel 44 and 46, i.e. a window, enabling observation of the operating region, and in particular of the doffing positions of the respective upper and lower chucks 24 and 26.

FIG. 3 again shows a front elevation of the frame 38 and the two movable doors 40 and 42. Also the outlines of two full packages 48 and 50 upon the respective upper and lower chucks 24 and 26 have also been shown in FIG. 3; normally, the winder or winding machine will not simultaneously carry two full packages in this way, but the illustrated state facilitates explanation of the relationship between the two movable doors 40 and 42 and the full packages 48 and 50 during doffing.

Figure 3:
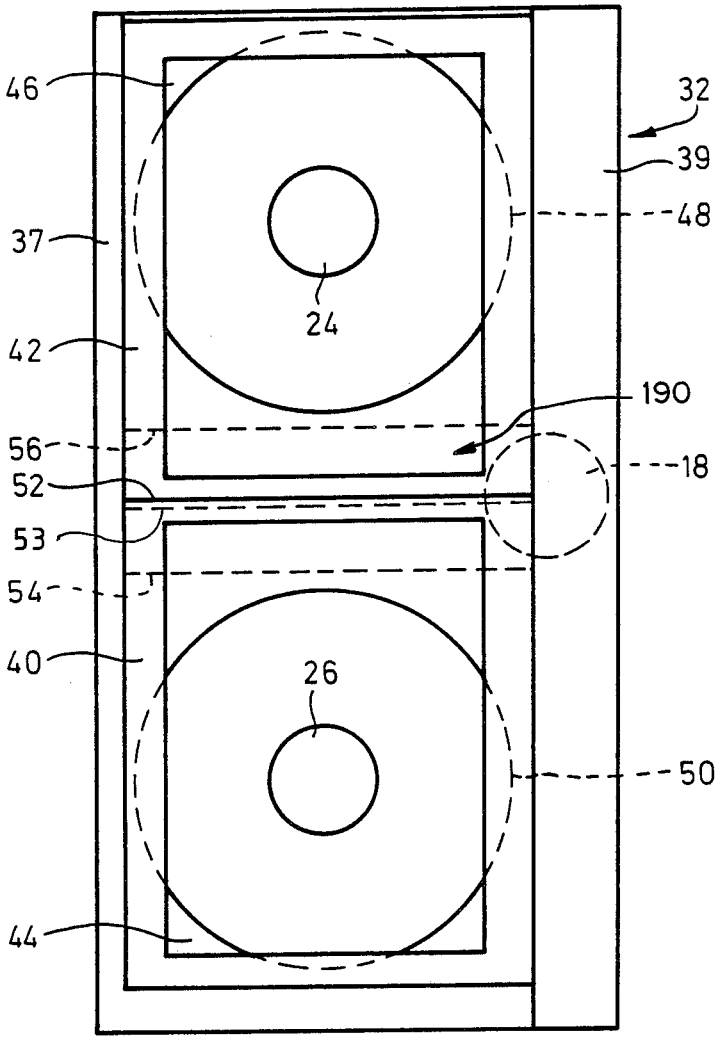
FIG. 3 is a front elevation of a door assembly also shown in FIG. 2 but drawn on an enlarged scale in relation to FIG. 2.

The full-line illustration in FIG. 3 represents the two movable doors 40 and 42 in their closed positions. As viewed from the front of the machine (cf. FIG. 3) the movable door 40 completely occupies the lower half of the space defined within the frame 38, and the movable door 42 completely occupies the upper half of that space. As best seen in FIG. 4, however, the movable door 40 is located in front of the movable door 42. Thus, the movable door 40 can be moved into the upper half of the frame 38, and the movable mutual interference of the two movable doors 40 and 42. The arrangements for causing and guiding such movement will be described later. As viewed in FIG. 3, there is only a very small degree of overlap of the two movable doors 40 and 42 at mid-height of the frame 38. A horizontal line 52 represents the upper edge of the movable door 40 and a dotted line 53 represents the lower edge of the movable door 42.

As will be described later with reference to the control system diagram in FIG. 6, the two movable doors 40 and 42 are never moved simultaneously, but only individually. The movable door 40 is raised to enable doffing of a full package 50 from the lower chuck 26, and the movable door 42 is lowered to enable doffing of a full package 48 from the upper chuck 24. When the movable door 40 is fully raised, its lower edge lies along the dotted line 54, that is just above the uppermost edge of the full package 50 as viewed from the front of the winding machine. Correspondingly, when the movable door 42 is fully lowered, its upper edge lies along the dotted line 56, that is just below the lowermost edge of the full package 46. Thus, when the appropriate movable door 40 or 42 is opened, a full package in the upper or lower doffing position can be readily removed from the operating region via the access opening created within the frame 38 by movement of the movable door 40 or 42 relative thereto. However, the central space or region 90 within the frame 38 lying between the lines 56 and 54 always remains blocked by one or the other or both of the two movable doors 40 and 42. As can be readily seen by reference to FIG. 2, this "permanently blocked" space contains the high-speed rotating components, such as the respective chuck 24 or 26 and the friction drive roll 18 during an ongoing winding operation. Accordingly, there is no direct access to this "danger zone" of the operating region even during doffing a full package.

The mounting of the two movable doors 40 and 42 in the frame 38, the source of motive power for these two movable doors 40 and 42, and the guidance thereof will now be described with reference to FIGS. 4 and 5. FIG. 4 shows a sectional plan view of the frame 38 with a central portion thereof omitted so that the more significant side members of the frame 38 can be illustrated on a larger scale. FIG. 5 shows in a front elevation corresponding to FIG. 3 lower corners of the frame 38 drawn on a scale corresponding to that of FIG. 4. As viewed in FIG. 4, a substantially U-shaped left-hand side member 37 of the frame 38 is substantially U-shaped in section, with an open side of the U facing inwardly of the frame 38. A substantially U-shaped right-hand member 39 is also U-shaped, with an open side thereof facing inwardly of the frame 38, but with legs of the U elongated to enable this member or U-shaped right-hand member 39 to contain additional elements as will be described.

Figure 4:
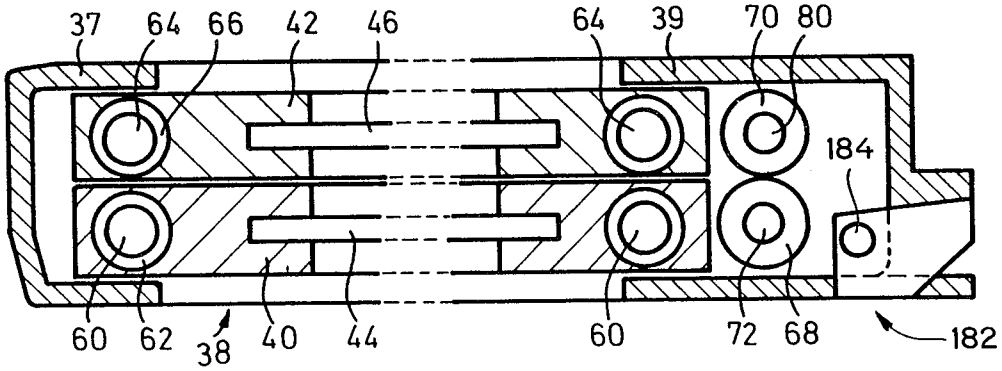
FIG. 4 is a sectional plan view of the door assembly shown in FIG. 3, the central portion thereof being omitted to enable illustration of the side elements to a further enlarged scale.

As clearly seen in FIG. 4, the two movable doors 40 and 42 are located with their left-hand edges just within the legs of the U-shaped left-hand side member 37 and their right-hand edges just within the legs of the U-shaped right-hand member 39. The movable door 40 has a pair of not particularly referenced substantially vertical, substantially parallel bores each extending from the top to the bottom edge thereof. By means of these bores, the movable door 40 is slidably mounted on a pair of parallel guide rods 60 extending between upper and lower horizontal members of the frame 38. For purposes of accurate and low-friction guidance of the movable door 40 relative to the guide rods 60, each bore is widened at each end thereof to receive a bearing sleeve 62 which fits accurately on a corresponding guide rod 60. The movable door 40 is thus accurately located relative to the guide rods 60 at each corner, although only the bearing sleeves 62 for the lowermost corners are visible in FIG. 5. The mounting and guidance of the movable door 42 is substantially the same, and will therefore not be described in detail. The guide rods for the movable door 42 are indicated at 64 in FIG. 4 and the lower bearing sleeves for the movable door 42 are indicated at 66 in the same FIG. 4.

Each movable door 40 and 42 is moved relative to the frame 38 by a respective piston and cylinder unit to be considered shortly, the two units being located side by side within the U-shaped right-hand member 39. The cylinder of the unit operating the movable door 40 is indicated at 68 in FIG. 4 and the cylinder of the unit operating the movable door 42 is indicated at 70. The cylinder 68 is fixed at a not particularly shown upper end thereof to the upper end of the U-shaped right-hand member 39, preferably by a pivotal connection enabling at least limited pivotal movement of the cylinder 68 on its fixing or mount. The cylinder 68 extends approximately halfway down the U-shaped right-hand member 39 from its fixing or mount. The not particularly shown conventional piston of this unit is connected to a connector rod 72. When the piston and cylinder unit is fully extended, that is when the piston is at the lowermost end of the cylinder 68, the lower end of the connector rod 76 is adjacent the bottom of the U-shaped right-hand member 39 and the lower edge of the movable door 40 as shown in FIG. 5. This free end of the connector rod 72 has a fitting comprising a first element 74 fixedly secured to the connector rod 72, a second element 76 fixedly secured to the adjacent, lower corner of the movable door 40 and a pivot joint 78 between the first and second elements 74 and 76, respectively. Thus, when this piston and cylinder unit is retracted, that is when the piston is urged upwardly along the cylinder 68, the movable door 40 is drawn upwardly along the guide rods 60 until movement of the piston ceases when the piston reaches the upper end of the cylinder 68.

The arrangement of the piston and cylinder unit operating the movable door 42 is analogous to that already described for the movable door 40, and explication of the details will therefore be omitted. The arrangement is, however, inverted relative to that for the movable door 40. That is, a cylinder 70 is fixed to the U-shaped right-hand member 39 adjacent the lower end of this U-shaped right-hand member 39 and extends upwardly approximately halfway along the U-shaped right-hand member 39. When a connector rod 80 (cf. FIG. 4) for the movable door 42 is fully extended, a free end thereof is located adjacent the upper end of the U-shaped right-hand member 39, and the fitting between the connector rod 80 and the movable door 42 is secured to the upper corner of that movable door 42. Accordingly, when the piston and cylinder unit operating the movable door 42 is retracted, this movable door 42 moves downwardly along the guide rods 64.

For the sake of completeness, brief reference is made here to a door latching mechanism built into the U-shaped right-hand member 39. This door latching mechanism is indicated generally at 182 in FIG. 4. It comprises a latching element 184 which can be moved out of a not particularly illustrated withdrawn or retracted position into an extended position illustrated in FIG. 5 in which it engages with a suitable cooperating member on the fixed wall portion 32. Since this arrangement, and a manual operating means also included in the latching mechanism 182, is of generally conventional construction, it will not be described in detail.

Figure 6:
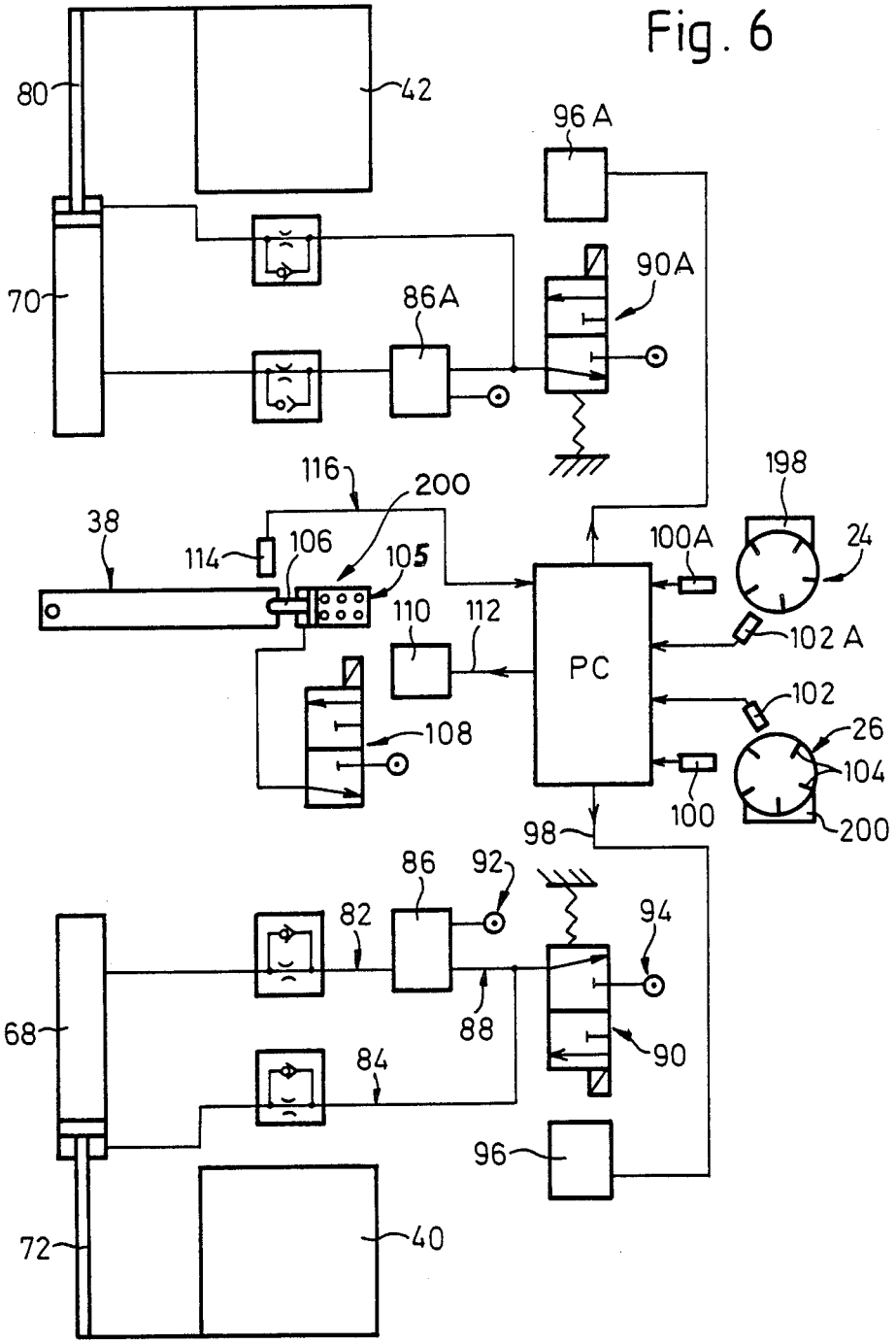
FIG. 6 is a diagrammatic representation of the door assembly in association with an operating system therefor, the control of such operating system and the interrelationship thereof with major operating elements of the machine.

FIG. 6 is a circuit diagram of a control system for operating the door assembly 32 shown in FIGS. 2 to 5. In this circuit diagram, the two movable doors 40 and 42 are shown again in association with their respective operating cylinders 68 and 70 and connecting rods 72 and 80. The frame 38 is represented separately in this diagram in the center portion thereof for reasons which will become apparent from the following description. The frame 38 is again assumed to be pivotable about its left-hand edge as viewed in FIG. 6. The respective upper and lower chucks 24 and 26 are indicated on the right-hand side of FIG. 6, each being assumed to be in contact with its respective brake-shoe carried by the support elements 198 and 200 respectively (that is, each chuck is assumed to be in its respective doffing position).

The machine as a whole is controlled by a programmable controller represented in FIG. 6 by the block PC. This can be in the form of a microprocessor, but many other forms of such controllers are now currently available, so that details of such conventional controllers will not be provided here. Essentially, the conventional controller PC is adapted to receive predetermined input signals, and to emit predetermined output signals for control purposes in dependence upon the sequence or combination or both of input signals received. The controller PC will be designed to control a very large number of functions in the machine, and will have many more inputs and outputs than those referred to here. The present description is confined to those inputs and outputs concerned with control of the door system. The arrangement for controlling the individual movable door 42 is substantially identical with that for control of the movable door 40. Accordingly, only the operation of the latter movable door 40 will be described although the control elements used for control of the former movable door 42 will also be referred to.

The cylinder 68 is a double-acting cylinder having chambers which can be pressurized via lines or conduits 82 and 84, respectively. The line or conduit 82 is connected to the output from one element 86 which will be further described below. The line or conduit 84 is connected to a lead 88 which extends between a valve 90, further described below, and one input to the element 86. Another input to the element 86 is connected to a source of pressure schematically indicated at 92 and the same or another source of pressure can provide the pressure input to the valve 90 indicated at 94.

The valve 90 is biased toward the illustrated state or position in which the line or conduit 88 is isolated from the pressure source 94. An operating mechanism 96 (for example, an electromagnetic device) is provided to operate the valve 90 against the bias in order to place the line or conduit 88 in flow communication with the pressure source 94. The mechanism 96 is selectively operable by the programmable controller PC on a control lead 98.

The element 86 is so arranged that the line or conduit 82 is in communication with the pressure source 92 in the illustrated state or position in which the line or conduit 88 is isolated from the pressure source 94. In this state, therefore, the upper chamber of the cylinder 68 is pressurized by the pressure source 92, the piston of the unit is moved to its lowermost position in the cylinder 68 and the movable door 40 is held in its lower position and therefore blocks access to the doffing position of the lower chuck 26.

When the mechanism 96 is operated, however, the line or conduit 84 is pressurized by the pressure source 94 and correspondingly pressurizes the lower chamber in the cylinder 68. The element 86 reacts to pressurization of the line or conduit 88 by isolating the line or conduit 82 from the pressure source 92 and connecting the line or conduit 82 to a suitable vent. The piston is therefore moved upwardly along the cylinder 68, drawing the movable door 40 upwardly along the guide rods 60 as described with reference to FIGS. 4 and 5. Access is therefore provided to the doffing position of the lower chuck 26 as described with reference to FIG. 3. The element 86 therefore functions as a logic or signal inverter or NOT-element, for example, of the type supplied by Crouzet SA, Valences, France, under the designation Type 81 504025.

The signal supplied by the controller PC to the operating mechanism 96 in order to cause the described operation of the valve 90 is produced by the controller PC in response to input signals it receives from two signal generators 100 and 102, respectively. The signal generator 100 is responsive simply to the presence of the lower chuck 26 in its doffing position. This signal generator 100 may be, for example, a proximity sensor adapted to respond to the presence of a part of the chuck structure in the neighborhood of the sensor. The signal generator 102 is designed to respond to rotation of the lower chuck 26. In the illustrated embodiment, this signal generator 102 is assumed to be a pulse generator adapted to generate pulse signals when it is passed by markings 104 on the circumference of the lower chuck 26 when the latter lower chuck 26 is rotating. When rotation of the lower chuck 26 ceases, and the markings 104 no longer pass by the signal generator 102, generation of pulses ceases.

When the controller PC receives a signal from the sensor or signal generator 100 indicating that the lower chuck 26 is in its doffing position, and at the same time does not receive a pulse sequence from the signal generator 102, the controller PC emits a signal on the line 98 causing operation of the operating mechanism 96. The mechanism operating signal will not, however, appear on the line 98 until any pulse sequence issued by the signal generator 102 has ceased, that is, the movable door 40 continues to block access to the doffing position of the lower chuck 26 until the latter lower chuck 26 has come to a standstill.

Since the same control elements are used to control operation of the movable door 42, the same basic reference numerals have been used to indicate those elements, and the reference character A has been added to each numeral to indicate the association of the respective element with the upper chuck 24 and the movable door 42. For clarity of the drawing, reference numerals have not been used to indicate the leads, lines or conduits and pressure sources associated with the movable door 42, but it is believed clear that when the valve 90A is operated, the piston will be moved downwardly along the cylinder 70, thereby causing downward movement of the movable door 42 along the guide rods 64 (cf. FIG. 4). Otherwise, the piston will be held at the upper end of the cylinder 70, maintaining the movable door 42 closed and blocking access to the doffing position of the upper chuck 24.

The controller PC also controls operation of a locking mechanism or unit 200 for the complete door assembly 32 (cf. FIG. 2). This locking mechanism or unit 200, which supplements the previously described latching mechanism 182, comprises an additional piston and cylinder unit 105 (cf. FIG. 6; also indicated in FIG. 2), the cylinder of which is fixedly secured to the fixed wall portion 30. The piston of the additional piston and cylinder unit 105 is secured to a locking pin 106 (cf. FIG.

6) and when the additional piston and cylinder unit 105 is extended, the locking pin 106 can enter a suitable not particularly referenced recess provided in the right-hand edge of the frame 38 when the door assembly 32 is in the closed position thereof. The additional piston and cylinder unit 105 is single-acting, being normally biased to its extended or locking state. The locking pin 106 can be retracted when the left-hand chamber (as viewed in FIG. 6) in the cylinder of the additional piston and cylinder unit 105 is pressurized by operation of a valve 108 similar to the valve 90. An operating mechanism 110 is provided, similar to the operating mechanism 96 and is correspondingly controllable by a signal from the controller PC along a lead 112. A suitable sensor 114, for example, a proximity sensor, responds to the presence of the door assembly 32 in the closed state or position and provides a corresponding input signal to the controller PC on the line 116.

Two of the manually operable buttons indicated on the control panel 36 in FIG. 2 may be respectively marked as "thread-up" and "start" buttons. The controller PC also responds to the conditions or states of these two manually operable buttons. When the "thread-up" button is pushed, the controller PC checks the state of each of the signal generators 100, 100A, 102 and 102A. A "release" signal on the line 112 causing operation of the valve 108 to withdraw the locking pin 106 will be produced only if both respective upper and lower chucks 24 and 26 are in their respective doffing positions and are not rotating. Failing this, a fault or error signal will be issued or transmitted. If the required conditions are satisfied, the locking pin 106 is withdrawn to enable opening of the door assembly 32 and to thereby enable threading-up as already described with reference to FIG. 2. When the door assembly 32 has been re-closed, this is indicated to the controller PC by a signal from the signal generator 114 on the line 116. If the "start" button is then pushed, the locking pin 106 is closed state and only then does the controller PC enable supply of energy to the chuck drives. If desired, however, the layout can be such that power is supplied to both the friction drive roll 18 and the conventional traverse mechanism 22 as soon as the "thread-up" button is pushed. After "start" of the machine, however, general access to the operation region via the door assembly 32 is prevented by the locking unit 200, and access to the doffing positions can be obtained only individually when the conditions for operation of the individual movable doors 40 and 42 are met as previously described above.

The side walls and top wall of the enclosure may each comprise a structural element, for example, a relatively thin metal sheet, and a covering element designed to absorb or otherwise damp noise emission from the enclosure. As will be explained more fully hereinafter arrangements can be provided to "climatize" the operating region. This is especially important for removing heat generated within the enclosure during operation. It can be effected by connecting the interior of the enclosure to a suitable air circulation system or by providing vents enabling selective limited communication for air flow between the interior and exterior of the enclosure or both.

It will be noted that the central space or region 190 between the two doffing positions cannot be exposed for access to the operating region by operation of the doffing doors or two movable doors 40 and 42, but only by opening of the complete door assembly 32. This central space or region 190 contains the friction drive roll 18 and is also the complete locus of movement of thread packages during winding operations on both the respective upper and lower chucks 24 and 26. Each doffing or movable door 40 or 42 provides free access only to its own associated doffing position, and not to an ongoing winding operation on the other chuck. If required, the central region could be blocked in or occupied by structure fixed relative to the complete door assembly 32, and the doffing or movable doors 40 and 42 could then be made correspondingly smaller. However, sealing arrangements in the central region may then become relatively complex, and it is preferred to provide overlapping movable doors 40 and 42 (generally as in FIG. 2). Suitable not particularly shown conventional sealing can be provided between the overlapped doffing or two movable doors 40 and 42.

In use, machines as illustrated are frequently arranged side-by-side in an array or battery. The minimum possible spacing is usually provided between the adjacent side walls. In theory, the side walls for intermediate machines within the array, that is those not at the exterior of the array, could be omitted provided adequate structure remains to support the front walls thereof. However, this is not the preferred arrangement. Instead, it is preferred to provide side walls even within the array, so that each winding machine forms an isolated unit. This minimizes the risk that faults in one unit can cause associated faults in an adjacent unit, and it also improves safety since access to the operating region of one unit provides no access whatsoever to the operating region of any other unit.

In a further development of this principle, arrangements may be made to sub-divide the interior of the enclosure to isolate at least partially or temporarily or both different portions of the operating region of an individual winder. Arrangements suitable for performing this sub-division function have already been disclosed in the initially mentioned commonly assigned U.S. Pat. No. 4,598,876, granted July 8, 1986, in the name of Kurt Schefer, and the disclosure of application is incorporated herein by reference. Other arrangements for sub-dividing the interior of the enclosure may, however, also be provided and used in conjunction with the present invention.

Modifications

Figure 7:
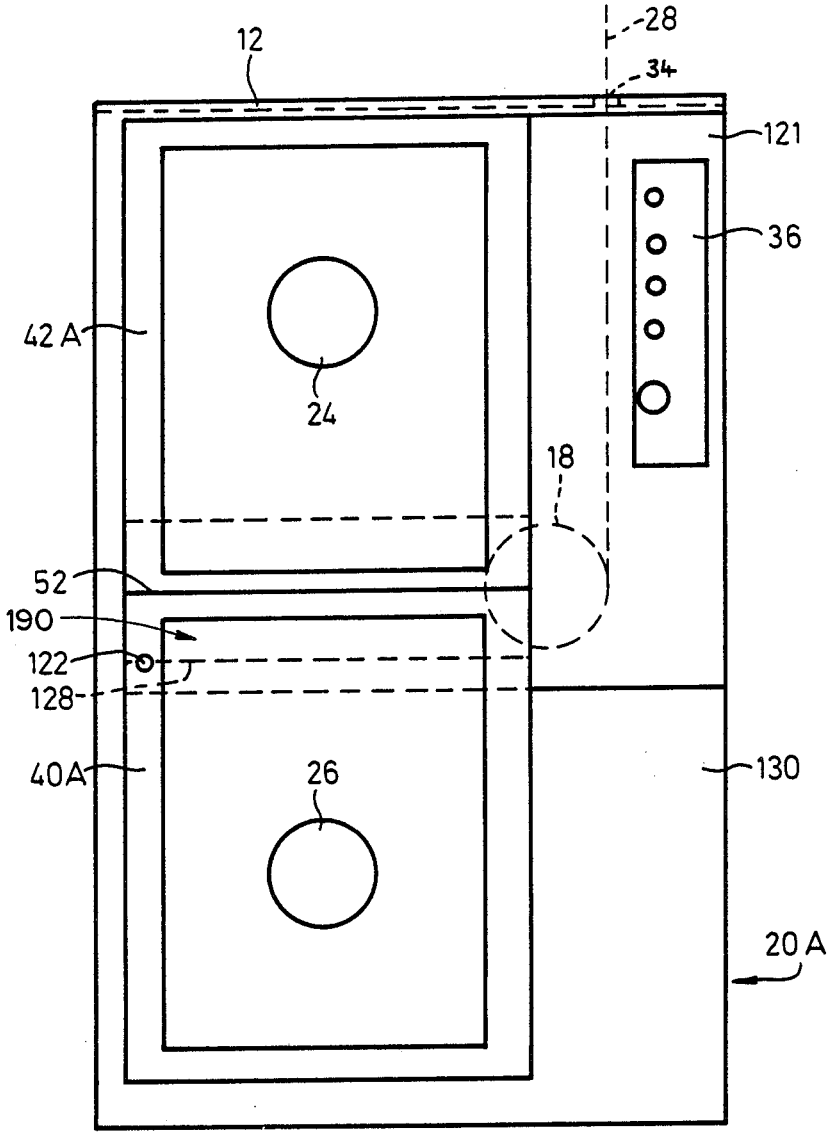
FIG. 7 is a view similar to FIG. 2 of an alternative embodiment of front wall for the enclosure of a machine of the type shown in FIG. 1.

The openable and closable door assembly 32 described with reference to FIGS. 2 to 5 is a desirable but not an essential feature of the invention. An alternative arrangement is shown in FIG. 7 where a modified front wall of the winder or winding machine is designated in its entirety by the reference numeral 20A. The outlines of the friction drive roll 18 and the respective upper and lower chucks 24 and 26 are indicated in dotted lines, and these elements are substantially identical to those shown and described in the previous embodiment. The two movable doors 40A and 42A are essentially the same as the correspondingly designated elements shown in FIG. 2. The line 52 represents the upper edge of the lower movable door 40A; the lower edge of the upper movable door 42A is concealed due to the overlap.

The fixed wall portion 130 now provides the support structure for the two movable doors 40A and 42A. However, an additional door 121 is provided in the right-hand, upper portion of the front wall, being hinged at its right-hand vertical edge (as viewed in FIG. 7) to enable the right-hand upper portion of the operating region to be exposed or accessible. The additional door 121 extends downwardly to a position slightly below the lowermost point on the friction drive roll 18. The control panel 36 is built into the additional door 121.

This additional door 121 is opened for threading up of the machine and it then exposes the front edge of the top plate or top plate extension 12 of the enclosure and of the slot 34 which is identical in arrangement and function to the slot 34 in FIG. 2. The thread path 28 as far as the friction drive roll 18 is therefore the same in FIGS. 2 and 7. In the embodiment of FIG. 7, however, the thread path downstream of the friction drive roll 18 for threading up does not extend upwardly from the friction drive roll or roller 18 as in FIG. 2, but substantially horizontally across the upper part of the movable door 40A as indicated by the path length of line 128 in FIG. 7. This portion of the thread path extends to a guide diagrammatically illustrated at 122 adjacent the left-hand side of the movable door 40A.

The movable door 40A must therefore be maintained open throughout the threading up operation to enable access to the guide 122 so that the thread path 128 can be established. The lowermost edge of the additional door 121 must also extend at least slightly below the lower edge of the movable door 40A when the latter movable door 40A is in its raised position.

After passing the guide 122, the thread is drawn forwardly out of the operating region through the access opening associated with the movable door 40A. During the start-up operation, the upper chuck 24 is moved downwardly into winding association with the friction drive roll 18, thereby taking up the thread along the path length 128. During this start-up operation, either the movable door 40A must be maintained open until take up of the thread by the upper chuck 24, or the movable door 40A must be provided with an openable and closable sub-section along its left-hand edge, the sub-section being opened to enable the thread to be drawn out of the machine even with the movable door 40A in its closed position during the start-up operation.

The two movable doors 40A and 42A can be guided by guide rods which on the left-hand side as viewed in FIG. 7 are identical to those described with reference to FIG. 4. Similar operating piston and cylinder units can be provided, being associated, however, with the left-hand sides of the two movable doors 40A and 42A in FIG. 7 instead of the right as in FIG. 4. The guide rods on the right-hand side must be discontinuous to enable the thread to be passed into the operating region from the front of the winding machine or winder.

FIG. 8 illustrates the application of the principles of this invention to an alternative type of continuous or wasteless winder or winding machine. In this embodiment, the friction drive roll is indicated at 180, one chuck at 124 and the other at 126; the conventional traverse mechanism has been omitted, but is substantially the same as that discussed with reference to the preceding figures. In this embodiment, however, the chucks 124 and 126 are carried on a common support or "revolver head" 132 which is rotatable about a central axis 134 extending parallel to the chuck axes. The general principle of such systems is well known in the art and will therefore not be described here in detail. In the state or position shown in FIG. 8, the one chuck 124 has just been brought into winding association with the friction drive roll 18, while the other chuck 126 has been moved to a doffing position and carries a full package, the outline of which is indicated at 136. While package winding continues on the one chuck 124, the full package can be removed from the other chuck 126 and replaced by one or more fresh bobbin tubes 102 ready for the next winding operation on the other chuck 126. When the winding operation on the one chuck 124 is completed, the revolver head 132 is rotated about the central axis 134 to bring the one chuck 124 into the doffing position and to move the other chuck 126 into operative association with the friction drive roll 180. During this changeover, not particularly shown conventional transfer means are effective for ensuring that the thread is transferred from the outgoing to the incoming chuck.

The different movements of the elements are possible in order to take account of build up of a thread package between the respective chuck 124 or 126 in the winding position and the friction drive roll 180. Thus, the revolver head 132 may be fixed in a specific angular disposition about its axis 134 during any one winding operation, and the friction drive roll 180 may be moved relative thereto, for example by vertical movement along the double-headed arrow 138 indicated in dotted lines in FIG. 8. Alternatively, the friction drive roll 180 may be disposed in a fixed position relative to the machine frame and the revolver head 132 may be rotatable about its axis 134, for example, as illustrated by the dotted line arrow 139, in order to enable package build up.

In the former case, the present invention can be applied relatively easily to this type of system, since there is a unique doffing position for both of the respective upper and lower chucks 124 and 126. Thus, in the front wall represented in FIG. 8 by a rectangle 120, a circular access opening can be defined of a dimension slightly greater than an outline 136 and centered upon the axis of the lower chuck 126 (or upper chuck 124) in the doffing position. This can be normally closed by a door 140 pivoted at 141 for rotation relative to the wall 120 about an axis extending parallel to the chuck axes, for example as indicated by the arrow 143. Opening of this door 140 enables access to the doffing position for both respective upper and lower chucks 124 and 126. A suitable not particularly shown conventional locking means similar to the locking means 200 (cf. FIG. 2), can be provided for retaining the door 140 in the closed state or position until the outgoing chuck has been located in the doffing position and brought to a standstill. Since the control of such a system is substantially the same as that already described with reference to FIG. 6, it will not be referred to again here. The whole of the front wall 120 may be hinged at the left-hand vertical edge (as viewed in FIG. 8) to enable threading up of the machine and suitable inlet openings must be provided for the threads during normal operation and suitable exit openings for the threads during threading up.

In the arrangement in which the revolver head 132 rotates during a winding operation, the doffing door must be made somewhat larger, since the doffing position wanders during an ongoing winding operation. This larger door might be made vertically slidable on the wall 120, so as to be raisable from the lower into the upper half of that wall 120. Preferably, however, the door is dimensioned to hinder access to the ongoing winding operation at all stages thereof.

The invention is not limited to the illustrated type of doors. Instead of sliding doors, for example, folding doors could be used, or flexible, rolling doors could be provided. Also, slat-type doors of the type shown in U.S. Pat. No. 3,146,572, granted Sept. 1, 1964, could be used.

The control system is only diagrammatically indicated in FIG. 6 to indicate the principles involved; modification to the system can be made as required. In particular, alternative means may be used to generate a signal or a combination of signals indicating that a chuck is in a required state or position. For example, arrangements are already known in accordance with which the braking force between the chuck and a brake-shoe is sensed, so that the package clamping means in the chuck is released only when the brake-force sensor indicates that the chuck has been braked to a standstill. This arrangement could be used to produce an appropriate signal for control of the doffing doors. With the aid of additional complexity or measures, the arrangement could be such that the door is permitted to open when the rotational speed of the chuck has dropped below a predetermined set value.

All of the actually illustrated embodiments of a winding machine are of the continuous winding type with friction drive roll systems. This is not essential. It will be clear from FIG. 8 that the principles of the invention are equally applicable to a single chuck winder, where a winding operation is broken off or interrupted during doffing of completed packages. The relevant doffing position is obviously that of the single chuck. Suitable devices may be provided within the enclosure to take up the thread upon completion of a winding operation. With increasing operating speeds, there is a tendency to move away from friction drive roll systems to direct drives, that is to systems in which the driving force is applied directly to the chuck instead of or in addition to the application of driving force via the circumference of the package. It will be clear that the principles of the invention are equally applicable to such systems.

Where the machine is to cooperate with an automatically operated package transport carriage, additional signals may be required for communication of the operating state of the winder to a control system. The latter may be a central control system for a complete installation including a battery of winding machines together with the package transport carriage. Alternatively it may be a control system on the carriage. In either case, the control system will need to "know" when the appropriate doffing door on the winder has been opened. For this purpose, additional signal generators and signal leads are required in the arrangement of FIG. 6.

The additional signal generators must be arranged to respond to the positions of the associated doffing doors or two movable doors 40 and 42, at least when those two movable doors 40 and 42 are in the open positions. The additional signal generators may include contact or non-contact position/proximity sensors. For example, each movable door 40 or 42 may carry a "marker" or "flag" on one side edge, for example, near the upper or lower edge, and this may be aligned with a marker/flag sensor on the frame elements, e.g. the U-shaped left-hand side member and the U-shaped right-hand member 37 and 39, respectively, when the movable door 40 or 42 is open. The sensors may be of the magnetic type, or photoelectric type. Preferably the marker is located near the upper door edge.

It will be appreciated by those familiar with the art that economy of space within the unit or sub-assembly formed by the frame 38 and the two movable doors 40 and 42 is critical. The diagrammatic representations in FIGS. 4 and 5 cannot give a clear impression in this respect. It will also be realized that this sub-assembly has to be supplied with pneumatic pressure fluid for operating the cylinders 68 and 70. Where additional signals are needed from the two movable doors 40 and 42 for control purposes, as described above, then electrical leads must also extend to and from the sub-assembly. The latter should also be mounted in the overall machine structure in a manner which facilitates removal therefrom for maintenance and servicing of both the sub-assembly and the machine. The connection between the sub-assembly and the machine should therefore be readily releasable. The pneumatic/electrical leads should be readily disconnectable at the same time. Freedom of movement of the sub-assembly as a door must of course be ensured.

In order to satisfy these requirements, it is suggested that the sub-assembly within the frame 38 should not be connected directly to the machine structure, but instead this sub-assembly should be pivotally secured to at least one support element and the latter should be releasably secured to the machine frame. A suitable arrangement is illustrated diagrammatically in FIG. 9, which is a view similar to FIG. 4 but showing only the left-hand door edge of FIG. 4 with the addition of such an auxiliary support element.

Figure 9:
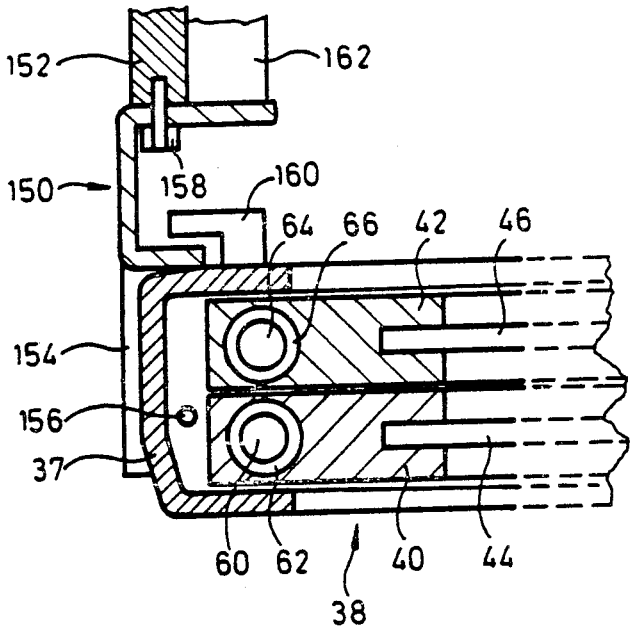
FIG. 9 shows an alternative detail corresponding to that of FIG. 4.

The arrangement shown in FIG. 9 assumes a single auxiliary support, in the form of an elongated channel element or section 150, extending over the full height of the left-hand, front edge portion 152 of the machine frame. At its upper and lower ends, elongated channel element 150 carries forwardly projecting lugs 154 (only the lower lug of which is visible in FIG. 9). Pivot pins 156 extend between the frame 38 and the lugs 154 on the elongated channel element 150, only the lower pin of which is visible in FIG. 9. The frame 38 is pivotable on these pivot pins 156 between its open and closed positions relative to the frame 38.

The elongated channel element 150 opens onto the interior of the machine enclosure. The rear side wall of the channel section engages the frame portion 152 and is releasably secured thereto, for example by bolts such as a bolt 158. The front side wall of the channel element or section 150 engages the frame element or U-shaped left-hand side member 37 when the frame 38 is in its closed position (as illustrated). Substantially L-shaped projections such as a projection 160, on the frame element or U-shaped left-hand side member 37 then engage behind the front wall of the channel element or section 150 and ensure that the movable door 40 or 42 remains shut at the hinge even in the event of an accident within the enclosure.

Figure 10:
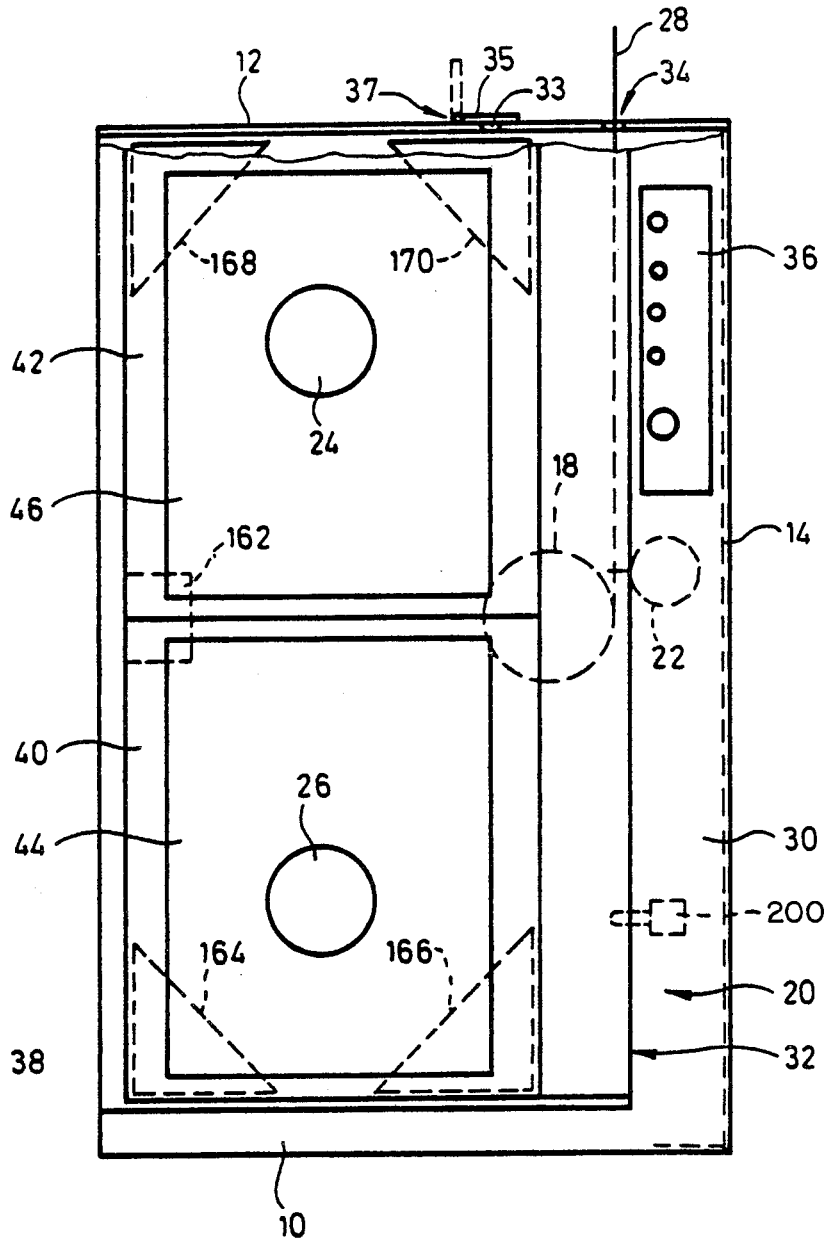
FIG. 10 shows a front elevation of an alternative construction of the access doors corresponding to FIG. 2.

Electrical and pneumatic leads pass from the machine headstock to the front edge of the frame portion 152 by way of a duct 162 indicated in dotted lines in FIG. 10, which is a view analogous to FIG. 2. This duct 162 is arranged with an equal spacing from each of the rest positions of the respective upper and lower chucks 24 and 26 to avoid interference with package build-up or with package storage in the rest positions of the respective upper and lower chucks 24 and 26. Not particularly shown conventional quick release connectors are provided between not particularly shown conventional leads in the sub-assembly and corresponding leads in the duct 162. These connectors are provided at predetermined positions on the end face of the duct 162 and on the corresponding mating face of the elongated channel element 150, and may be manually or automatically engaged when the elongated channel element 150 is correctly located on the machine or support frame.

FIG. 10 also shows further details of an additional feature already mentioned above, namely the conditioning or climatization system for the interior of the enclosure. Lower ducts 164 and 166 and upper ducts 168 and 170 are formed in the corners of the operating region. These lower and upper ducts 164, 166, 168 and 170, respectively, occupy the free space left around the packages on the respective upper and lower chucks 24 and 26, in the rest positions, without of course interfering with chuck movement. Each duct 164, 166, 168 and 170 extends from the front face of the machine rearwards through the operating region to the headstock. Spaced along the length of each lower and upper duct 164, 166, 168 and 170 is a set of ports enabling air flow between the operating region and the interior of the respective lower and upper duct 164, 166, 168 or 170.

The lower ducts 164 and 166 are arranged as cool air inflow ducts. They may be connected together in not particularly shown conventional manner within the headstock 16 to a cool air infeed from a separate source associated with the complete installation, for example, an air conditioning system for the plant.

The upper ducts 168 and 170 are arranged as warm air exit ducts. They may also be connected together in not particularly shown conventional manner within the headstock housing 16 and thereby linked into an overall air conditioning system. Alternatively, of course, the machine may be provided with its own fan, and the cool air infeed may draw air from the workroom surrounding the machine, in which case filters may be provided in the air flow system within the machine.

While there are shown and described present preferred embodiments of the invention, it is to be distinctly understood that the invention is not limited thereto, but may be otherwise variously embodied and practiced within the scope of the following claims.

Accordingly, what we claim is:

1.A machine for winding thread having an operating region in which thread packages are formed and retained to await doffing thereof and having at least one predetermined doffing position in the operating region, comprising:

headstock means;

at least two chucks;

means for cantilever mounting of said at least two chucks in the headstock means and so as to extend forwardly therefrom into the operating region;

each of said at least two chucks defining a respective lognitudinal chuck axis;

said at least two chucks each being rotatable about said respective longitudinal chuck axis for winding thread into thread packages thereon;

a thread traverse mechanism extending forwardly of said headstock means into the operating region for selectively winding a thread onto each of said at least two chucks into a respective thread package during a winding operation at a predetermined winding position of the operating region;

means mounting each of said at least two chucks to be selectively movable between the predetermined winding position in the operating region and the at least one predetermined doffing position;

means for selectively bringing each of said at least two chucks into said predetermined winding position of the operating region for coaction with the thread traverse mechanism to wind a thread package thereon and for bringing each of said at least two chucks into the region of the at least one predetermined doffing position for doffing a wound thread package from the related chuck;

an enclosure for the operating region;

said enclosure being provided with an access opening to the at least one predetermined doffing position;

said enclosure being provided with an inlet permitting infeed of at least one thread to the predetermined winding position;

at least one access door arranged in said enclosure; and means for accomplishing movement of said at least one access door relative to said enclosure for exposing said access opening to the at least one predetermined doffing position while said enclosure hinders access to said thread traverse mechanism, a thread package forming upon one of the chucks located in the predetermined winding position and the thread extending between the inlet and the thread package forming upon one of the chucks located in the predetermined winding position.

2. The machine as defined in claim 1, wherein:

said at least two chucks comprise a first chuck and a second chuck arranged in the operating region such that a thread can be transferred from said first chuck to said second chuck upon completion of a winding operation on said first chuck; and said enclosure including means structured such as to hinder access to a portion of the operating region in which an ongoing winding operation is proceeding at the predetermined winding position during doffing of a package from said first chuck via said access opening.

3. The machine as defined in claim 2, wherein:

said at least one predetermined doffing position defines at least two doffing positions;

said at least one access door comprises two access doors each associated with a respective doffing position of said at least two doffing positions; and said means for accomplishing movement of said at least one access door includes means for independently operating and opening said two access doors.

4. A machine for winding thread having an operating region in which thread packages are formed and retained to await doffing thereof, comprising:

at least one chuck arranged in the operating region and defining a longitudinal chuck axis;

said at least one chuck being rotatable about said longitudinal chuck axis for winding thread into a package thereon;

means for selectively moving said at least one chuck in the operating region between a package winding position and a doffing position;

an enclosure for the operating region;

at least one access door arranged in said enclosure;

controllably releasable retaining means operable for retaining said at least one access door in a predetermined state closing said enclosure and releasable for permitting opening of said at least one access door for providing access to said at least one chuck for removing a completed package therefrom;

sensing means responsive to a predetermined rotational state of said at least one chuck and to the location of said at least one chuck in said doffing position; and control means responsive to said sensing means and operable for controlling said retaining means such that said at least one access door cannot be released unless said at least one chuck is in said predetermined rotational state and in said predetermined doffing position.

5. The machine as defined in claim 4, wherein:

said sensing means determines whether said at least one chuck is rotationally stationary and which rotationally stationary state defines said predetermined rotational state of said at least one chuck.

6. The machine as defined in claim 4, further including:

a sensor means responsive to said predetermined state of said at least one access door;

controllable drive means for driving said at least one chuck;

said controllable drive means being controllable by said control means; and said control means being responsive to said sensor means responsive to said predetermined state of said at least one access door such that said drive means cannot be energized unless said at least one access door is in said predetermined state.

7. A machine for winding thread having an operating region in which packages are formed and retained to await doffing thereof, comprising:

at least one chuck arranged in the operating region and defining a longitudinal chuck axis and rotatable about said longitudinal chuck axis for winding thread into a package;

said at least one chuck having a predetermined doffing position spaced from a winding position in the operating region;

means mounting said at least one chuck to be selectively movable between said winding position and said predetermined doffing position;

means for selectively moving said at least one chuck between said winding position and said predetermined doffing position;

an enclosure for the operating region;

a doffing access door movable relative to said enclosure for providing access to said at least one chuck in said predetermined doffing position for removing packages therefrom; and a further access door movable relative to said enclosure for providing access to the operating region for operations other than doffing.

8. The machine as defined in claim 7, further including:

means for mounting said doffing access door on and movable relative to said further access door.

9. The machine as defined in claim 7, wherein:

said doffing access door is separate from said further access door.

10. The machine as defined in claim 7, wherein:

said further access door is larger than said doffing access door.

11. The machine as defined in claim 7, further including:

a machine frame;

a support element releasably secured to said machine frame; and said further access door being openable by a movement of said further access door relative to said support element.

12. The machine as defined in claim 11, further including:

releasable connections for power leads cooperating with said further access door and located at a position where said support element adjoins said machine frame.

13. The machine as defined in claim 11, wherein:

said further access door is pivotable about a substantially vertical axis relative to said support element.

14. The machine as defined in claim 11, further including:

a component secured to said machine frame;

hinge means for hingedly mounting said further access door relative to said machine frame; and said further access door being arranged to engage said component at a location adjacent said hinge means when said further access door is closed.

15. The machine as defined in claim 7, wherein:

said enclosure is provided with an entry opening through which a thread can be passed into the operating region during winding of packages and with an exit opening through which said thread can be withdrawn from said enclosure during a threading and start-up operation.

16. The machine as defined in claim 15, further including:

means for closing said exit opening during a normal winding operation of the machine.

17. A machine for winding thread having an operating region in which thread packages are formed and retained to await doffing thereof, comprising:

at least two chucks arranged in the operating region and defining respective longitudinal axes;

each chuck of said at least two chucks being rotatable about a respective longitudinal axis of said respective longitudinal axes for winding thread into a package thereon;

each said chuck having a respective doffing position in which said chuck is located for removal of a complete package therefrom;

an enclosure for the operating region;

said enclosure being provided with two access openings respectively associated with the respective doffing position of each said chuck and two doors each associated with a respective access opening of said two access openings;

means cooperating with each door for mounting each door for movement relative to said enclosure;

said means mounting each door for movement relative to the enclosure cooperating with each door so as to allow each door of said two doors to be movable relative to said enclosure between an operating position closing a respective access opening and an inoperative position in which it leaves a therewith associated access opening of said two access openings free for removing a thread package but overlies at least partly the other access opening of said two access openings.

18. The machine as defined in claim 17, wherein:

said means cooperating with each door for mounting each door for movement relative to said enclosure comprise respective guide tracks disposed one behind the other as viewed longitudinally of the longitudinal chuck axes; and said two doors being movable along said respective guide tracks.

19. The machine as defined in claim 17, further including:

means for linearly reciprocating each door of said two doors relative to said enclosure.

20. The machine as defined in claim 17, wherein:

said means cooperating with each door for mounting each door for movement relative to said enclosure comprise structure for mounting said two doors so as to be arranged to mutually overlap when said two access openings are closed.

21. The machine as defined in claim 17, wherein:

said two access openings are separated by an intermediate region which is blocked by at least one of said two doors throughout a normal winding operation.

22. The machine as defined in claim 1, further including:

a friction roll extending forwardly from said headstock means into the operating region and cooperating with said thread traverse mechanism and each chuck when in the predetermined winding position; and said enclosure further hindering access to the friction roll when said at least one access door is moved relative to the enclosure for exposing the access opening to the at least one predetermined doffing position.

23. A machine for winding thread comprising:

headstock means;

at least one chuck;

means defining an operating region in which thread packages are formed on said at least one chuck;

means for mounting said at least one chuck in said headstock means so as to project forwardly therefrom into the operating region;

means for rotating said at least one chuck so as to form a thread package thereon in said operating region;

said means defining said operating region including an enclosure for the operating region;

said enclosure being provided in part by said headstock means; and air circulating ducts provided with outlet means and inlet means which open into said operating region and extending therefrom into said headstock means.

24. The machine as defined in claim 23, wherein:

said enclosure includes corner regions; and said enclosure defines a substantially rectangular operating region and said inlet means and said outlet means of said air circulating ducts are disposed in the corner regions of said enclosure.

25. The machine as defined in claim 24, wherein:

said air circulating ducts are adapted for connection to an air circulating system having leads extending to the headstock means.

26. The machine as defined in claim 23, wherein:

said air circulating ducts are adapted for connection to an air circulating system having leads extending to the headstock means.

27. The machine as defined in claim 23, wherein:

said inlet means of said air circulating ducts are located at a lower part of said operating region and said outlet means of said air circulating ducts are located in an upper part of said operating region.

28. The machine as defined in claim 23, wherein:

said enclosure comprises a front wall spaced from said headstock means;

said air circulating ducts extend from said headstock means to said front wall; and said inlet means and said outlet means of said air circulating ducts being distributed over predeterminate lengths of said air circualating ducts within said operating region.

* * * * *

UNITED STATES PATENT AND TRADEMARK OFFICE

CERTIFICATE OF CORRECTION

PATENT NO. : 4,762,284

DATED : August 9, 1988

INVENTOR(S) : ADOLF FLüELI et al

It is certified that error appears in the above-identified patent and that said Letters Patent is hereby corrected as shown below:

Column 10, line 60, after "movable" please insert --door 42 into the lower half of the frame 38, without causing--

Column 11, line 20, please delete "90" and insert --190--

Column 16, line 8, after "central" please insert --space or-- and after "region" please insert --190--

Column 26, line 33, please delete "circualating" and insert --circulating--

Signed and Sealed this

Fourteenth Day of March, 1989

*Attest:*

*Attesting Officer*

DONALD J. QUIGG

*Commissioner of Patents and Trademarks*